US009886892B2

(12) United States Patent
Zhang et al.

(10) Patent No.: US 9,886,892 B2
(45) Date of Patent: Feb. 6, 2018

(54) GATE DRIVING CIRCUIT, GATE DRIVING METHOD, AND DISPLAY APPARATUS

(71) Applicants: BOE Technology Group Co., Ltd., Beijing (CN); Beijing BOE Display Technology Co., Ltd., Beijing (CN)

(72) Inventors: Chunbing Zhang, Beijing (CN); Yi-Chiang Lai, Beijing (CN); Liang Zhang, Beijing (CN)

(73) Assignees: BOE TECHNOLOGY GROUP CO., LTD., Beijing (CN); BEIJING BOE DISPLAY TECHNOLOGY CO., LTD., Beijing (CN)

( * ) Notice: Subject to any disclaimer, the term of this patent is extended or adjusted under 35 U.S.C. 154(b) by 161 days.

(21) Appl. No.: 14/785,667

(22) PCT Filed: Apr. 16, 2015

(86) PCT No.: PCT/CN2015/076736
§ 371 (c)(1),
(2) Date: Oct. 20, 2015

(87) PCT Pub. No.: WO2016/065863
PCT Pub. Date: May 6, 2016

(65) Prior Publication Data

US 2016/0351113 A1 Dec. 1, 2016

(30) Foreign Application Priority Data

Oct. 27, 2014 (CN) ..... 2014 1 0584227

(51) Int. Cl.
*G09G 3/36* (2006.01)
*G09G 3/20* (2006.01)
*G09G 5/18* (2006.01)

(52) U.S. Cl.
CPC ..... *G09G 3/2096* (2013.01); *G09G 3/2007* (2013.01); *G09G 3/2018* (2013.01);
(Continued)

(58) Field of Classification Search
CPC ..... G09G 2310/0267; G09G 3/2011; G09G 2330/021; G09G 2310/06; G09G 3/2018;
(Continued)

(56) References Cited

U.S. PATENT DOCUMENTS 8,325,126 B2 * 12/2012 Cheng ..... G09G 3/3611 345/95
9,013,384 B2 4/2015 Al-Dahle et al.
(Continued)

FOREIGN PATENT DOCUMENTS

CN 101221742 7/2008
CN 101315749 12/2008
(Continued)

OTHER PUBLICATIONS

Extended European Search Report for European Patent Application No. 15777855.6, dated Feb. 27, 2017, 11 pages.
(Continued)

*Primary Examiner* — Duc Dinh
(74) *Attorney, Agent, or Firm* — Westman, Champlin & Koehler, P.A.

(57) ABSTRACT

The present disclosure provides a gate driving circuit, a gate driving method, and a display apparatus. The gate driving circuit comprises a driving control unit and a gate signal generation unit, wherein the driving control unit is configured to generate a driving control signal corresponding to a respective display pattern, and the gate signal generation unit is connected to the driving control unit and is configured to generate a multi-order gate voltage in response to the driving control signal generated by the driving control unit,
(Continued)

wherein duration of a low order voltage included in the generated multi-order gate voltage corresponds to the respective display pattern. The gate driving circuit according to the present disclosure can achieve driving for display by using a multi-order gate voltage having a low order voltage in long duration when the corresponding display apparatus is in a flicker pattern, so as to eliminate image flicker.

9 Claims, 3 Drawing Sheets

(52) U.S. Cl.
CPC ..... *G09G 5/18* (2013.01); *G09G 3/3677* (2013.01); *G09G 2310/0267* (2013.01); *G09G 2310/08* (2013.01); *G09G 2320/0247* (2013.01); *G09G 2320/0257* (2013.01)

(58) Field of Classification Search
CPC ... G09G 2320/0252; G09G 2320/0209; G09G 2320/0247; G09G 2320/0257; G09G 3/2051; G09G 3/3696; G09G 2310/027; G09G 2310/08; G09G 2310/0289; G09G 2320/043; G09G 2320/103
USPC ..... 345/98–100
See application file for complete search history.

(56) References Cited

U.S. PATENT DOCUMENTS

2005/0248550 A1* 11/2005 Kobayashi ..... G09G 3/3677 345/204
2007/0040795 A1 2/2007 Lee et al.
2008/0238897 A1 10/2008 Kimura
2009/0189883 A1* 7/2009 Chung ..... G09G 3/3674 345/213
2009/0295779 A1 12/2009 Yanagi et al.

FOREIGN PATENT DOCUMENTS

CN 101520994 A 9/2009
CN 101520998 9/2009
CN 101916540 12/2010
CN 101937640 A 1/2011
CN 101976556 A 2/2011
CN 102800288 A 11/2012
CN 104299588 A 1/2015
JP H06-110035 A 4/1994
JP 2007-264241 A 10/2007
WO 2013/185039 A1 12/2013
WO WO 2014/161241 10/2014

OTHER PUBLICATIONS

Second Office Action, including Search Report, for Chinese Patent Application No. 201410584227.5 dated Aug. 10, 2016, 15 pages.
Office Action from Chinese Patent Application No. 201410584227.5, dated Mar. 28, 2016.
International Search Report and Written Opinion for PCT Application No. PCT/CN2015/076736, dated Jul. 17, 2015, 9 pages.
English translation of Box No. V from the Written Opinion for the International Searching Authority for PCT Application No. PCT/CN2015/076736, 2 pages.

* cited by examiner

GATE DRIVING CIRCUIT, GATE DRIVING METHOD, AND DISPLAY APPARATUS

CROSS-REFERENCE TO RELATED APPLICATION(S)

This application is a Section 371 National Stage Application of International Application No. PCT/CN2015/076736, filed on 16 Apr. 2015, entitled "GATE DRIVING CIRCUIT, GATE DRIVING METHOD, AND DISPLAY APPARATUS", which has not yet published, which claims priority to Chinese Application No. 201410584227.5, filed on 27 Oct. 2014, incorporated herein by reference in their entirety.

TECHNICAL FIELD

The present disclosure relates to the field of display technology, and more particularly, to a gate driving circuit, a gate driving method, and a display apparatus.

BACKGROUND

An amorphous silicon bottom gate type Thin Film Transistor (TFT), as a switch element, is primarily characterized in that there is a jump voltage (ΔVp) at a switching instant, and when different voltages are applied to the TFT, the generated jump voltages ΔVp are also different. In a flicker pattern, such jump voltage may results in a problem that an image flickers seriously.

In view of the above problem, a low order voltage (the low order voltage and a high order voltage commonly form a multi-order gate voltage MLG) is generally provided before gate off to reduce ΔVp, thereby improving the flicker phenomenon. The longer the low order voltage is applied, the more obvious the effect of overcoming the flicker phenomenon is. However, in a high resolution display apparatus, the charging time for each pixel in one frame is relatively short. As a result, if the low order voltage is applied for a long time, the charging rate for the pixel is not sufficient, which will influence the display quality. If the low order voltage is applied for a short time, the effect of overcoming the flicker phenomenon is not sufficiently obvious, i.e., the flicker phenomenon due to ΔVp cannot be effectively avoided.

SUMMARY

Therefore, embodiments of the present disclosure provide a gate driving circuit and a gate driving method which can not only avoid image flicker but also can avoid V-Block.

According to an aspect of the present disclosure, a gate driving circuit is provided, comprising: a driving control unit and a gate signal generation unit, wherein the driving control unit is configured to generate different driving control signals suitable for different display patterns; and the gate signal generation unit is connected to the driving control unit and is configured to generate a multi-order gate voltage in response to the driving control signal generated by the driving control unit, wherein duration of a low order voltage included in the generated multi-order gate voltage corresponds to the respective display pattern.

In an implementation of the present disclosure, the driving control unit comprises: a timing controller and multiple controlled switch unit, wherein the timing controller has multiple pulse signal output ends suitable for generating multiple pulse signals and is configured to output pulse signals with different widths through different pulse signal output ends, wherein a pulse signal is suitable for a display pattern; and each of the controlled switch units is arranged between a pulse signal output end of the timing controller and a driving control signal input end of the gate signal generation unit, and various controlled switch units are connected to different pulse signal output ends, wherein the multi-order gate voltage is generated by the gate signal generation unit in response to the pulse signal, and comprises a low order voltage in duration consistent with a width of the pulse signal.

In an implementation of the present disclosure, the various controlled switch units are transistors having first electrodes respectively connected to pulse signal output ends of the timing controller and second electrodes respectively connected to driving control signal input ends of the gate signal generation unit.

In an implementation of the present disclosure, the driving control unit further comprises a controller connected to a control end of each controlled switch unit, and configured to control turn-on/turn-off of the respective controlled switch unit in response to the detected display pattern.

In an implementation of the present disclosure, the timing controller is suitable for generating three pulse signals with different widths suitable for a normal pattern, a flicker pattern, and a gray level display pattern respectively.

According to another aspect of the present disclosure, a gate driving method is provided, comprising:

generating a driving control signal corresponding to a current display pattern according to the current display pattern; and generating, by a gate signal generation unit, a multi-order gate voltage according to the driving control signal, wherein duration of a low order voltage included in the generated multi-order gate voltage corresponds to the respective display pattern.

In an implementation of the present disclosure, in a flicker pattern, the gate signal generation unit generates a multi-order gate voltage having a low order voltage in first duration; in a normal display pattern, the gate signal generation unit generates a multi-order gate voltage having a low order voltage in second duration; and in a gray level display pattern, the gate signal generation unit generates a multi-order gate voltage having a low order voltage in third duration, wherein the first duration is larger than the second duration and the second duration is larger than the third duration.

According to another aspect of the present disclosure, a display apparatus is provided, comprising the gate driving circuit described in any of the above embodiments.

DETAILED DESCRIPTION

Detailed description of the present disclosure will be further described below in conjunction with accompanying drawings and embodiments. The following embodiments are merely used to illustrate the technical solutions of the present disclosure more clearly, instead of limiting the protection scope of the present disclosure.

Figure 1:
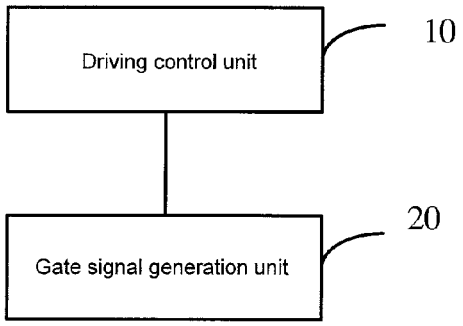
FIG. 1 illustrates a structural diagram of a gate driving circuit according to an embodiment of the present disclosure.

The embodiments of the present disclosure provide a gate driving circuit. As shown in FIG. 1, the gate driving circuit comprises a driving control unit 10 configured to generate a driving control signal corresponding to a respective display pattern; and a gate signal generation unit 20 connected to the driving control unit 10 and configured to generate a multi-order gate voltage in response to the driving control signal generated by the driving control unit 10, wherein duration of a low order voltage included in the generated multi-order gate voltage corresponds to the respective display pattern.

Those skilled in the art should understand that in the embodiments of the present disclosure, as the driving control unit can generate a corresponding driving control signal in a respective display pattern, the driving signal generation unit can determine a current display pattern according to a current input driving control signal, and generate a multi-order gate voltage having a low order voltage in duration corresponding to the respective display pattern. In a specific implementation, duration of a low order voltage in a particular display pattern may be set according to the requirements of those skilled in the art. In order to achieve a better display effect, the terms "corresponding" means that the low order gate voltage in the respective multi-order gate voltage can avoid the display problem generated in the display pattern.

It should be understood that the terms "low order voltage" in the embodiments of the present disclosure refer to a voltage with a smaller absolute value in the multi-order gate voltage. Specifically, for an active-high gate voltage, the low order voltage should be lower than the high level voltage, and for an active-low gate voltage, an absolute value of the low order voltage should be lower than an absolute value of the low level signal.

The gate driving circuit according to the present disclosure can achieve driving for display by using a multi-order gate voltage having a low order voltage in long duration when the display pattern of the display apparatus is a flicker pattern, so as to eliminate the undesirable phenomenon that an image flickers, and achieve driving for display by using a multi-order gate voltage having a low order voltage in short duration when the display pattern is a gray level display pattern, so as to avoid V-Block, thereby improving the quality of the image display. Even if the whole effective gate voltage signal has short duration, the gate driving circuit according to the embodiments of the present disclosure can also prevent the V-Block phenomenon while avoiding the image from flickering. The effect of avoiding the image from flickering is more obvious especially in a high PPI display apparatus.

Specifically, the gate signal generation unit here may be a conventional driver Integrated Circuit (Driver-IC). The following description is given by taking the gate signal generation unit being a Driver-IC as an example. The Driver-IC is used to generate a gate voltage signal required for driving a gate. In practical applications, various effective gate voltage signals for driving and controlling have the same duration.

Figure 2:
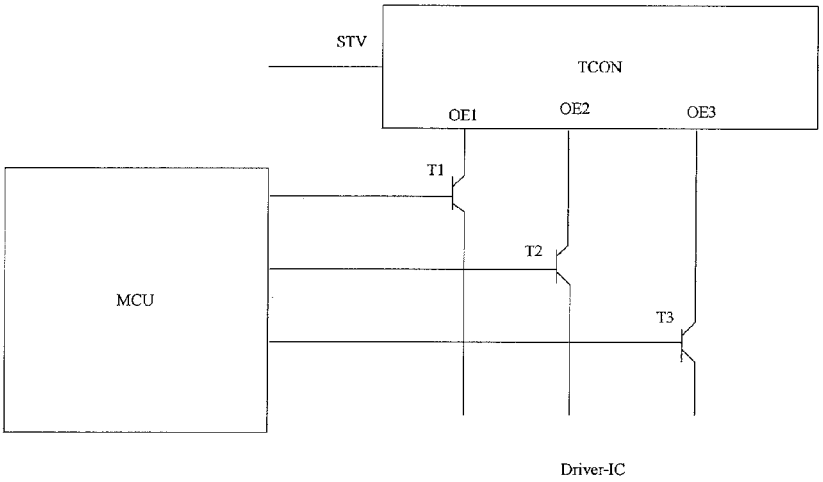
FIG. 2 illustrates a structural diagram of a driving control unit in FIG. 1.

In an alternative implementation, as shown in FIG. 2, the driving control unit 20 in FIG. 1 may specifically comprise:

a timing controller TCON and three controlled switch units T1, T2 and T3. The TCON has at least three pulse signal output ends OE1, OE2 and OE3, which can generate three pulse signals with different widths, and output the pulse signals through respective pulse signal output ends, wherein the three pulse signals with different widths correspond to a display pattern, a flicker pattern, and a gray level display pattern respectively. A first end of the first controlled switch unit T1 is connected to OE1, a first end of the second controlled switch unit is connected to OE2, and a first end of the third switch unit is connected to OE3. Second ends of various controlled switch units are connected to driving control signal input ends of the Driver-IC. Generally, the low order voltage has the longest duration in the flicker pattern, has smaller duration in the normal pattern than the flicker pattern, and has the smallest duration in the gray level display pattern.

In this case, the pulse signals become the driving control signal. The Driver-IC generates respective multi-order gate voltages in response to the pulse signals with different duration.

More specifically, the Driver-IC may generate a multi-order gate voltage in response to a pulse signal, wherein the multi-order gate voltage comprises a low order voltage in duration consistent with a width of the pulse signal.

In practical applications, a particular controlled switch unit may be controlled to turn on at the right time by applying suitable control signals to the control ends of various controlled switch units, so that the Driver-IC generates a suitable multi-order gate voltage, thereby improving the image quality.

In a specific implementation, as shown in FIG. 2, the TCON further comprises a clock signal output end for outputting a clock signal STV to achieve image synchronization.

It should be noted that although FIG. 2 illustrates a condition that the TCON generates three pulse signals with different widths and outputs the pulse signals through three pulse signal output ends, in practical applications, the TCON may also only generate two pulse signals with different widths and output the pulse signals through two pulse signal output ends, which can also avoid the problems of flicker and V-Block at the same time. The same problem can also be solved by generating more than three pulse signals with different widths and providing more than three output ends. However, such scheme may have a relatively complex design. Such configuration in the embodiments of the present disclosure has an advantage of providing a multi-order gate voltage corresponding to a normal display pattern, to achieve a better display effect and a relatively simple design.

The driving control unit illustrated in FIG. 2 has features of a simple structure and ease of control. However, in practical applications, the functions of the driving control unit may also be achieved by other structures. That is, the structure in FIG. 2 should not be construed as limiting the protection scope of the present disclosure.

Further, as shown in FIG. 2, various controlled units T1, T2 and T3 according to the embodiments of the present disclosure are transistors. T1, T2 and T3 have first electrodes respectively connected to the pulse signal output ends OE1-OE3 of the TCON, and second electrodes respectively connected to the driving control signal input ends of the Driver IC. Of course, in practical applications, other switch units which can be turned on or turned off according to the control signal may also be selected.

Figure 3:
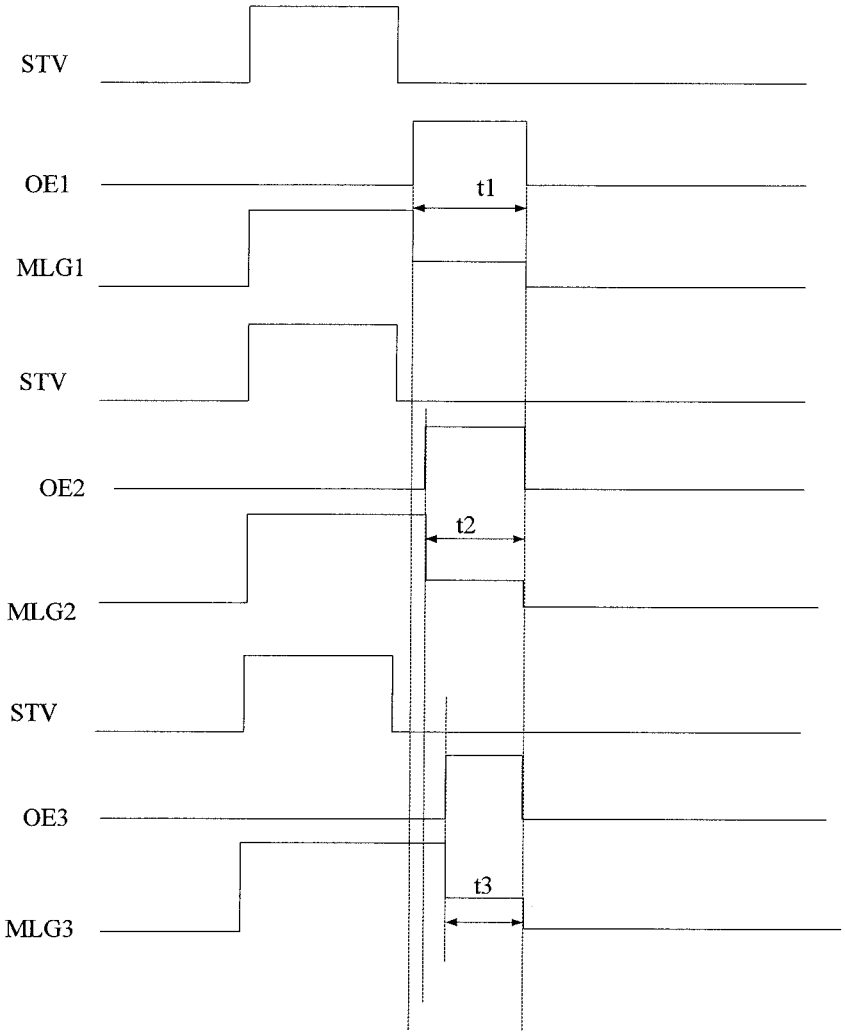
FIG. 3 illustrates a timing diagram of a part of signals in a gate driving circuit according to an embodiment of the present application.

Generally, the width of the pulse signal finally determines the duration of the low order voltage in the multi-order gate voltage. As shown in FIG. 3, when T1 is turned on, OE1 inputs a pulse signal with a width of t1 to the Driver-IC. In this case, the duration of the low order voltage in the multi-order gate voltage MLG1 generated by the Driver-IC is also t1. Correspondingly, when T2 is turned on, OE2 inputs a pulse signal with a width of t2 to the Driver-IC. In this case, the duration of the low order voltage in the multi-order gate voltage MLG2 generated by the Driver-IC is also t2. When T3 is turned on, OE3 inputs a pulse signal with a width of t3 to the Driver-IC. In this case, the duration of the low order voltage in the multi-order gate voltage MLG3 generated by the Driver-IC is also t3. Further, it can be seen from the figure that the total duration of various effective multi-order gate voltages MLG1, MLG2 and MLG3 should be consistent, and have the same starting position as that of the STV.

Further, as shown in FIG. 2, the driving control unit according to the embodiments of the present disclosure further comprises a controller MCU, which is connected to control ends (gates) of various controlled switch units and controls turn-on/turn-off of respective controlled switch units according to the detected display type.

Figure 4A:
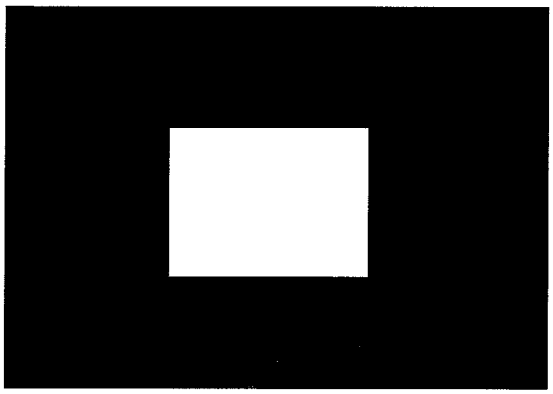
FIG. 4A illustrates illustrations of the gray level display pattern and FIG. 4B illustrates illustrations of the flicker pattern.
Figure 4B:
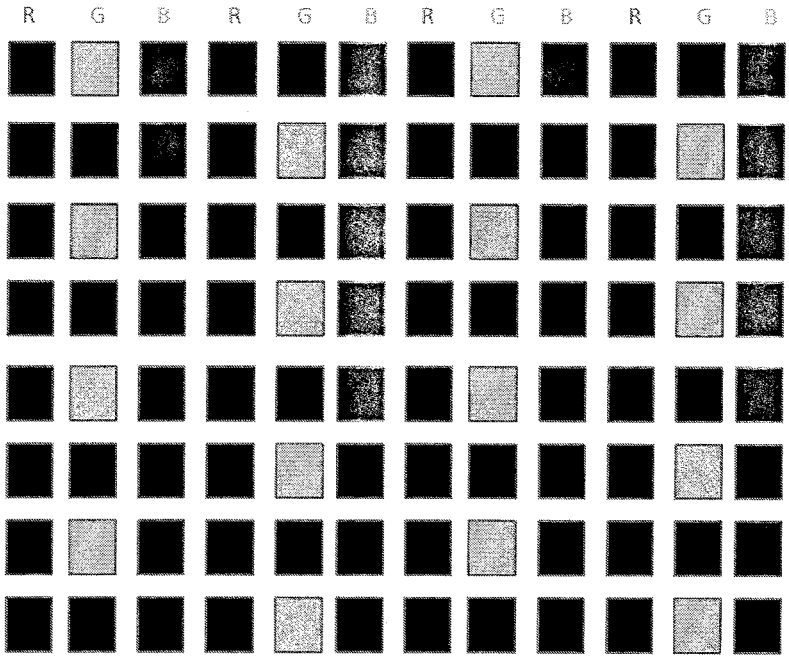

FIG. 4A illustrates illustrations of the gray level display pattern and FIG. 4B illustrates illustrations of the flicker pattern.

In a specific implementation, the controller here may be a main controller MCU of the whole display apparatus, which controls the light-emitting and display of the whole display apparatus, and can acquire the display pattern of the next frame before the next frame is displayed. In this case, the main controller controls turn-on/turn-off of various switch units according to the display pattern of the next frame.

The embodiments of the present disclosure further provide a gate driving method, comprising:

generating a driving control signal corresponding to a current display pattern according to the current display pattern, and generating, by a gate signal generation unit, a multi-order gate voltage according to the driving control signal, wherein duration of a low order voltage included in the generated multi-order gate voltage corresponds to the respective display pattern.

According to the embodiments of the present disclosure, in a flicker pattern, a multi-order gate voltage having a low order voltage in long duration is applied, which can better prohibit a jump voltage of the switch TFT and reduce the flicker degree. In a gray level display pattern, a multi-order gate voltage having a low order voltage in short duration is applied, which can better improve the charging rate and avoid the phenomenon of V-Block. In a normal display pattern, the duration of the low order voltage in the applied multi-order gate voltage is between the long duration and the short duration described above, which achieves moderate charging time for a capacitor, and is beneficial for improving the image quality. For example, in a case that the multi-order voltage is a two-order voltage, the low order voltage may have a value equal to 30%-60% of a normal driving voltage, and have duration which occupies 5%-50% of the duration of the whole multi-order voltage.

The gate driving method according to the embodiments of the present disclosure may be achieved by the above gate driving circuit.

The embodiments of the present disclosure further provide a display apparatus, comprising the gate driving circuit described in any of the above embodiments.

The display apparatus here may be any product or component having a display function such as an electronic paper, a mobile phone, a tablet computer, a television, a display, a notebook computer, a digital photo frame, a navigator or the like.

The above description is merely preferable embodiments of the present disclosure. It should be noted that a number of improvements and variations can further be made by those skilled in the art without departing from the technical principle of the present disclosure, and all of these improvements and variations should also be construed as falling within the protection scope of the present disclosure.

We claim:

1. A gate driving circuit, comprising:

a driving control unit configured to generate a driving control signal corresponding to a display pattern; and a gate signal generation unit connected to the driving control unit and configured to generate a multi-order gate voltage in response to the driving control signal generated by the driving control unit, wherein the display pattern comprises one of a normal display pattern, a flicker display pattern, and a gray level display pattern;

in the flicker pattern, a duration of a low order voltage included in the multi-order gate voltage generated by the gate signal generating unit equals to a first duration, in the normal display pattern, the duration of the low order voltage included in multi-order gate voltage generated by the gate signal generation unit equals to a second duration; and in the gray level pattern, the duration of the low order voltage included in multi-order voltage gate generated by the gate signal generation unit equals to a third duration, wherein the first duration is larger than the second duration and the second duration is larger than the third duration.

2. The circuit according to claim 1, wherein the driving control unit comprises:

a timing controller having multiple pulse signal output ends suitable for generating multiple pulse signals and configured to output pulse signals with different widths through respective pulse signal output ends, wherein the widths of the pulse signals corresponds to respective display patterns; and controlled switch units each arranged between a respective pulse signal output end of the timing controller and a respective driving control signal input end of the gate signal generation unit, wherein the multi-order gate voltage generated by the gate signal generation unit in response to the pulse signal comprises a low order voltage in duration consistent with a width of the pulse signal.

3. The circuit according to claim 2, wherein each controlled switch unit comprises a transistor having a first electrode and a second electrode respectively connected to a respective pulse signal output end of the timing controller and a respective driving control signal input end of the gate signal generation unit.

4. The circuit according to claim 2, wherein the driving control unit further comprises a controller connected to a control end of each controlled switch unit, and configured to control turn-on/turn-off of the respective controlled switch unit in response to the detected display pattern.

5. A display apparatus, comprising the gate driving circuit according to claim 1.

6. A display apparatus, comprising the gate driving circuit according to claim 2.

7. A display apparatus, comprising the gate driving circuit according to claim 3.

8. A display apparatus, comprising the gate driving circuit according to claim 4.

9. A gate driving method, comprising:

generating a driving control signal corresponding to a current display pattern according to the current display pattern; and generating, by a gate signal generation unit, a multi-order gate voltage according to the driving control signal, wherein the display pattern comprises one of a normal display pattern, a flicker display pattern, and a gray level display pattern; wherein, in the flicker pattern, the gate signal generation unit generates a multi-order gate voltage having a low order voltage in duration equal to a first duration; in a normal display pattern, the gate signal generation unit generates a multi-order gate voltage having a low order voltage in duration equal to a second duration; and in a gray level pattern, the gate signal generation unit generates a multi-order gate voltage having a low order voltage in duration equal to a third duration, wherein the first duration is larger than the second duration and the second duration is larger than the third duration.

* * * * *